US011685595B2

(12) United States Patent
Giordano

(10) Patent No.: US 11,685,595 B2
(45) Date of Patent: Jun. 27, 2023

(54) UNIT FOR TRANSPORTING EGGS WITH INTERMEDIATE PARTITIONS

(71) Applicant: Giordano Poultry Plast S.p.A., Caraglio (IT)

(72) Inventor: Oscar Giordano, Caraglio (IT)

(73) Assignee: GIORDANO POULTRY PLAST S.P.A., Caraglio (IT)

( * ) Notice: Subject to any disclaimer, the term of this patent is extended or adjusted under 35 U.S.C. 154(b) by 90 days.

(21) Appl. No.: 16/636,152

(22) PCT Filed: May 9, 2018

(86) PCT No.: PCT/IB2018/053224
§ 371 (c)(1),
(2) Date: Feb. 3, 2020

(87) PCT Pub. No.: WO2019/102274
PCT Pub. Date: May 31, 2019

(65) Prior Publication Data

US 2020/0369460 A1 Nov. 26, 2020

(30) Foreign Application Priority Data

Nov. 21, 2017 (IT) ..... 202017000132954

(51) Int. Cl.
*B65D 85/32* (2006.01)
*B65D 57/00* (2006.01)

(52) U.S. Cl.
CPC ..... *B65D 85/328* (2013.01); *B65D 57/003* (2020.05)

(58) Field of Classification Search
CPC .... B65D 85/328; B65D 57/003; B65D 57/00; B65D 85/32; B65D 71/0088; B65D 85/321; B65D 85/322
(Continued)

(56) References Cited

U.S. PATENT DOCUMENTS 1,397,540 A * 11/1921 Odell ..... B65D 85/322 217/26
1,970,436 A * 8/1934 Shepard ..... B65D 85/322 217/26.5

(Continued)

FOREIGN PATENT DOCUMENTS

| | | | |
|---|---|---|---|
| AU | 2010226639 | A1 | 4/2011 |
| RU | 178472 | U1 | 4/2018 |
| WO | 2010095935 | A1 | 8/2010 |

OTHER PUBLICATIONS

International Search Report and Written Opinion of the International Searching Authority for International Application No. PCT/IB2018/053224 dated Jul. 23, 2018.

*Primary Examiner* — J. Gregory Pickett
*Assistant Examiner* — Jenine Pagan
(74) *Attorney, Agent, or Firm* — Heslin Rothenberg Farley & Mesiti P.C.; Victor A. Cardona, Esq.

(57) ABSTRACT

A unit for transporting eggs includes a platform carrying superimposed horizontal layers of egg-holder trays and intermediate partitions interposed between the plurality of superimposed horizontal layers. Parallel to two opposite sides of the partition are stop elements projecting upwards suitable to cooperate with corresponding lower abutments of the egg-holder trays of the lowest layer of the corresponding plurality of superimposed horizontal layers. The stop elements are spaced by the two opposite sides of the partition, towards the inside thereof.

2 Claims, 6 Drawing Sheets

(58) Field of Classification Search
USPC ..... 206/503, 521.1, 561, 386, 511; 220/507, 220/508, 513
See application file for complete search history.

(56) References Cited

U.S. PATENT DOCUMENTS

| | | | | | |
|---|---|---|---|---|---|
| 2,345,274 | A * | 3/1944 | Manson | B65D 85/322 | 217/26.5 |
| 2,346,161 | A * | 4/1944 | Grant | B65D 85/32 | 217/26.5 |
| 2,925,206 | A * | 2/1960 | Hancock | B65D 7/20 | 294/169 |
| 3,282,458 | A * | 11/1966 | Rudd | B65D 85/322 | 217/26.5 |
| 3,478,867 | A * | 11/1969 | Weiss | B65D 5/0055 | 206/564 |
| 3,877,599 | A * | 4/1975 | Morris | B65D 85/321 | 217/26.5 |
| 5,205,410 | A | 4/1993 | Kuipers et al. | | |
| 5,694,836 | A * | 12/1997 | Blevins | A23B 5/00 | 206/386 |
| 6,032,801 | A * | 3/2000 | Jupille | B65D 1/38 | 108/55.3 |
| 6,276,531 | B1 * | 8/2001 | Andrews | B65D 85/32 | 206/511 |
| 7,909,164 | B2 * | 3/2011 | Andrews | B65D 85/32 | 206/521.1 |
| 2011/0094917 | A1 * | 4/2011 | Soehnlen | B65D 85/32 | 206/521.7 |

* cited by examiner

UNIT FOR TRANSPORTING EGGS WITH INTERMEDIATE PARTITIONS

CROSS REFERENCE TO RELATED APPLICATIONS

This application is a national stage filing under section 371 of International Application PCT/IB2018/053224, filed on May 9, 2018, published in English on May 31, 2019 as WO 2019/102274 A1, and claims priority to Italian Patent Application No. 202017000132954, filed on Nov. 21, 2017. The entire disclosures of each application are hereby incorporated herein by reference.

FIELD OF THE INVENTION

The present invention generally refers to the transportation of eggs on board trucks, and more in particular it regards a transportation unit comprising a platform with quadrangular base on which egg-holder trays are stacked.

STATE OF THE ART

As a matter of fact, in transportation units thus made there are typically provided a first plurality of superimposed horizontal layers of egg-holder trays arranged on the platform, further pluralities of superimposed horizontal layers of egg-holder trays stacked on the first plurality, and intermediate partitions interposed between the pluralities of superimposed layers. Each partition usually consists of a sheet made of moulded plastic material with shape corresponding to the platform and provided, parallel to two opposite sides thereof, with stop elements projecting upwards suitable to cooperate with corresponding lower abutments of the egg-holder trays of the lowermost layer of the corresponding plurality of superimposed horizontal layers.

The stop elements have the function of centring the superimposed layers of egg-holder trays during the formation of the transportation unit, which is normally carried out by means of mechanised handling devices. Such stop elements are normally positioned peripherally at the edges of the aforementioned two opposite sides of each partition. Given that the dimensions of the partitions are standardised, in that they depend on the width of the transportation unit which is in turn determined by that of the loading deck of transportation vehicles, the mutual distance between the stop elements is, due to the peripheral position thereof, determined strictly. Given that the dimensions of the egg-holder trays and thus of the horizontal layers of such trays are also standardised, there is no possibility of allowing even the slightest clearance between the layers of trays and the partitions, which potentially entails problems during the mechanised formation of the transportation unit. For example, given that the trays are also made of moulded plastic material, any lesser shrinkage of the material of some egg-holder trays following the moulding could lead to exceeding in size beyond the tolerance value due to which the relative layer of trays could end up fitting in an undesired manner between the stop elements.

SUMMARY OF THE INVENTION

The object of the present invention is to overcome the aforementioned drawback, by enabling to provide the required and sufficient clearance between the layers of egg-holder trays and the relative partitions.

According to the invention, this object is attained by virtue of the fact that said stop elements are spaced from the aforementioned two sides of the partition, towards the inside of the partition.

Due to this characteristic, the stop elements can be obtained at a mutual distance which is not strictly determined by the dimensions of the partition and such to enable—between the horizontal layers of egg-holder trays and the partition—the required clearance so that the drawbacks mentioned above regarding the mechanised formation of the transportation unit are eliminated.

BRIEF DESCRIPTION OF THE DRAWINGS

The invention will now be described in detail with reference to the attached drawings, provided purely by way of non-limiting example, wherein.

DETAILED DESCRIPTION OF THE INVENTION

Figure 2:
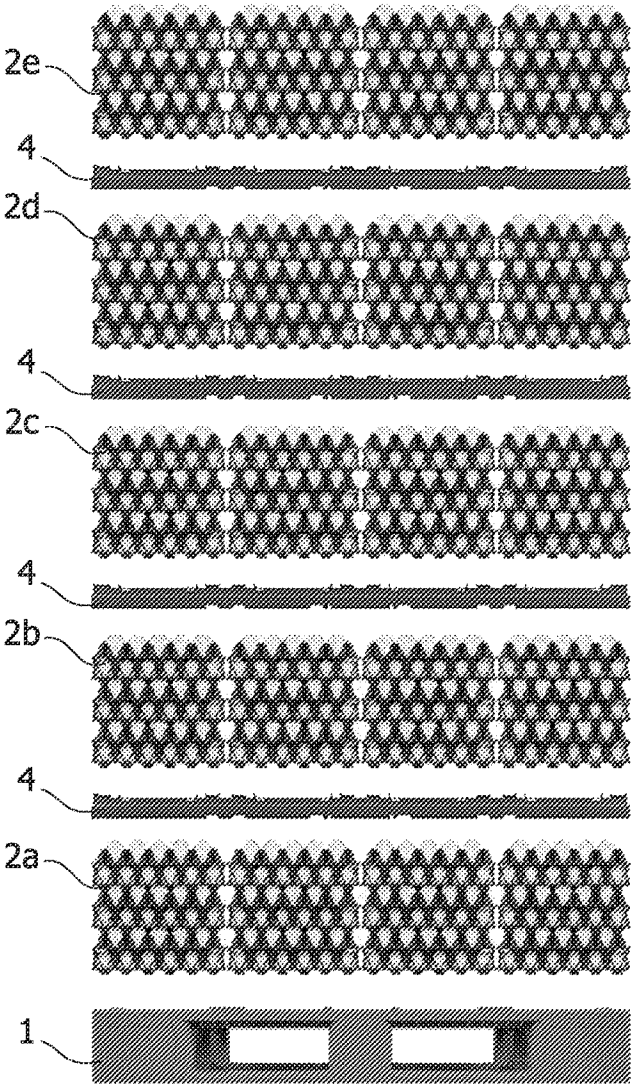
FIG. 2 is an exploded view of FIG. 1.
Figure 1:
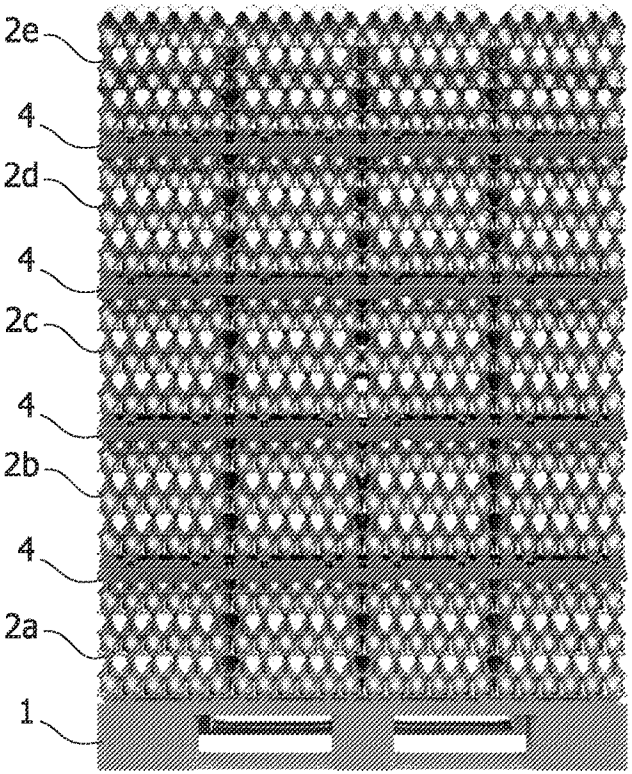
FIG. 1 is an elevational schematic view of an embodiment of the unit for transporting eggs according to the invention.
Figure 3:
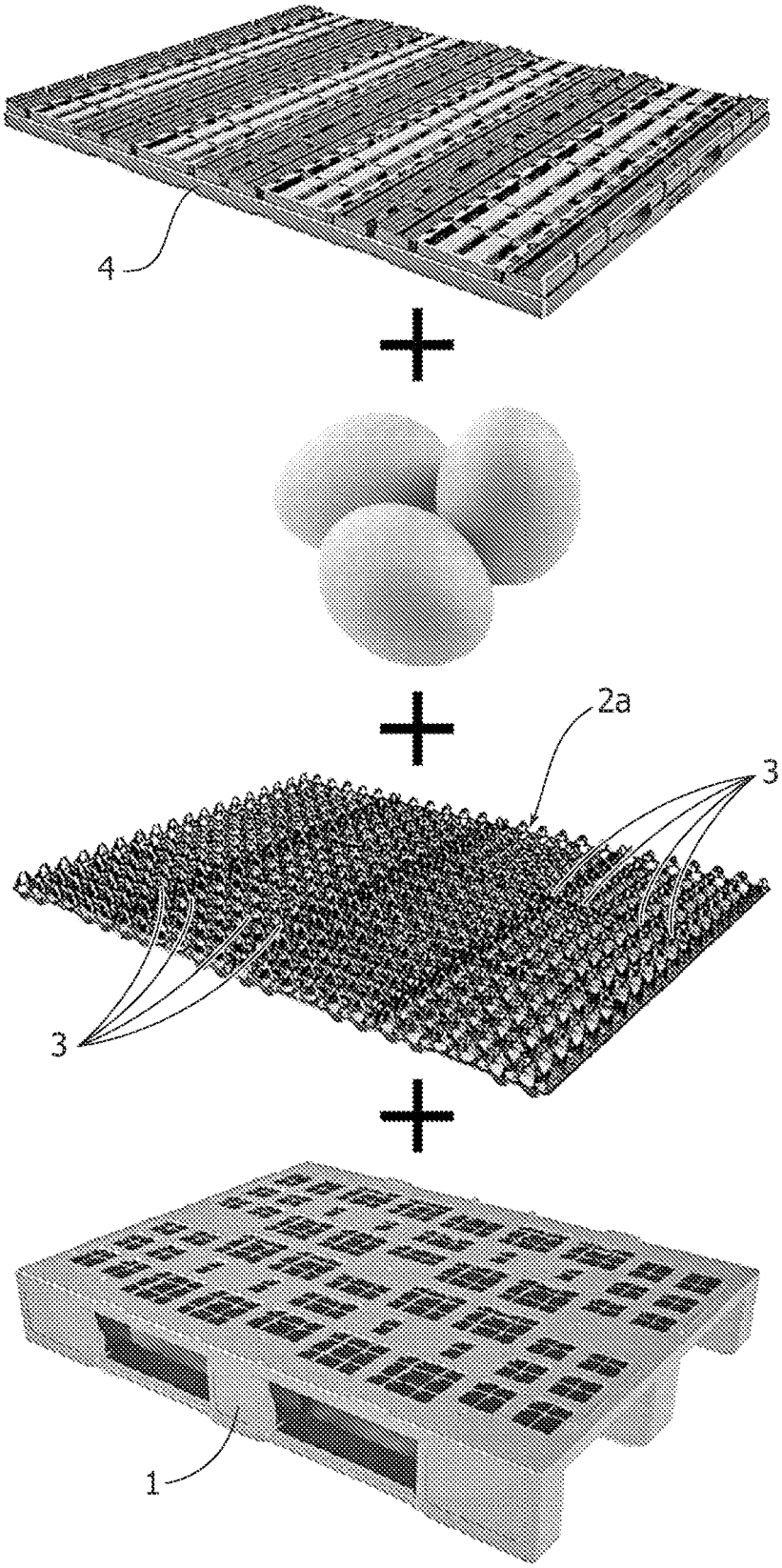
FIG. 3 is an exploded and partial perspective view of the transportation unit.

Initially with reference to FIGS. 1 and 2, a unit for transporting eggs essentially comprises a platform with rectangular base 1 on which a first plurality 2*a* of superimposed horizontal layers of egg-holder trays 3 lies. In the case of the illustrated example, the first plurality 2*a* includes five layers each one of which is formed by three rows of four egg-holder trays 3, thus for a total of twelve egg-holder trays 3 each one of which is made up—in a per se known manner—of a body made of moulded plastic material for example defining thirty cells for an equivalent number of eggs.

On the first plurality 2*a* of superimposed horizontal layers of egg-holder trays 3 there are stacked further superimposed horizontal layers of egg-holder trays 3, for example a second, a third, a fourth and a fifth layer 2*b*, 2*c*, 2*d*, 2*e*. Between each pair of pluralities of superimposed layers 2*a*-2*b*, 2*b*-2*c*, 2*c*-2*d* and 2*d*-2*e* there is interposed a respective intermediate partition 4 which constitutes the specific object of the present invention.

Each partition 4 is made up of a sheet made of moulded plastic material, having a rectangular shape corresponding to that of the platform 1 and provided, parallel to the two greater sides 5 thereof, with stop elements of the relative plurality of superimposed layers of egg-holder trays 3, whose function is to determine the precise positioning thereof during the formation of the transportation unit typically carried out by means of mechanised handling equipment. The arrangement, in the case of the illustrated example, is such that the three rows of four egg-holder trays 3 of the various layers are parallel to the larger sides 5,5 of the partitions 4.

Figure 4:
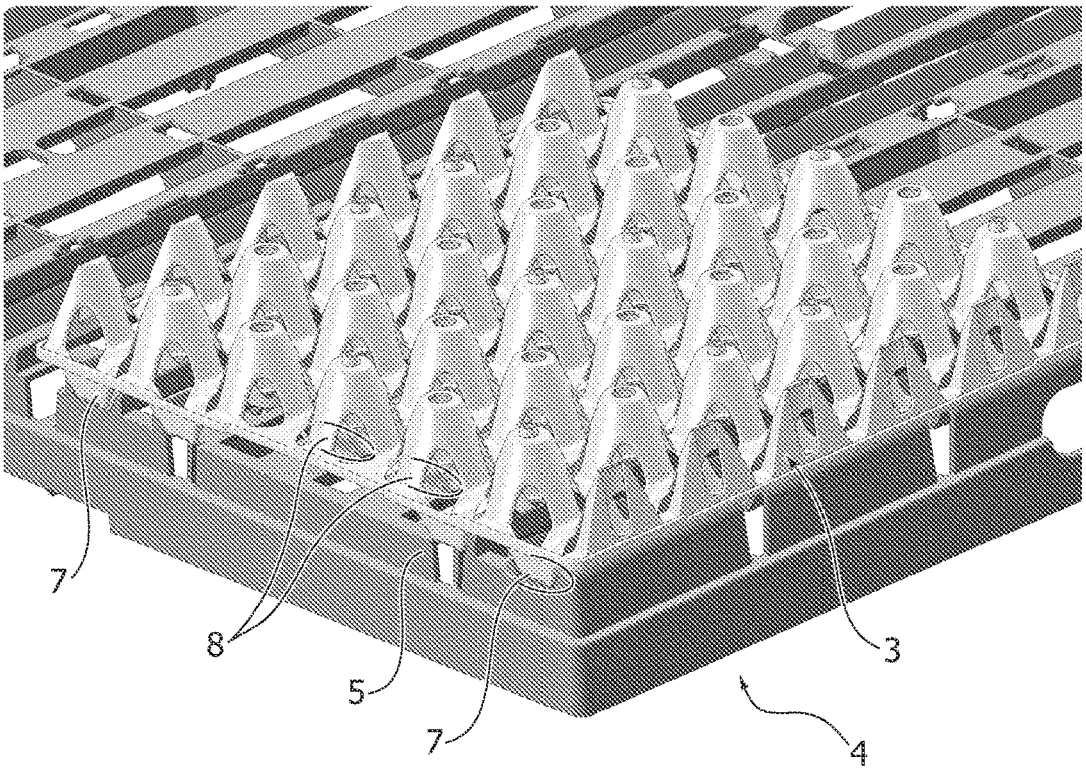
FIG. 4 PRIOR ART
FIG. 4 is a schematic perspective view and in larger scale showing a detail of a transportation unit according to the prior art.
Figure 6:
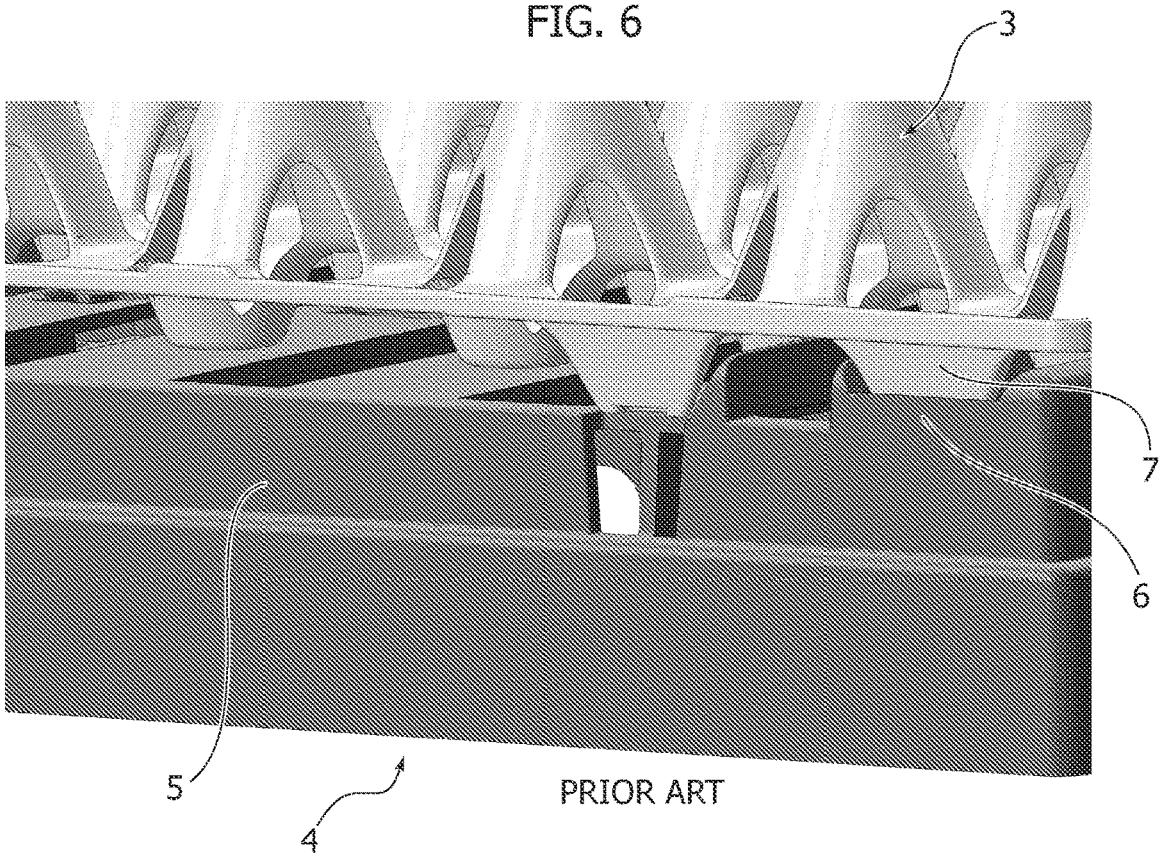
FIG. 6 shows an enlarged detail of FIG. 4.

FIGS. 4 and 6 show—in detail—the conformation of the stop elements of a partition 4 according to the prior art: they are constituted by containment projections 6 arranged peripherally at each side 5,5 of the partition 4 and abutting against which there are corresponding support feet 7 with which the egg-holder trays 3 of the lowermost layer are provided at the lower part. The mutual distance between the projections 6 of one side 5 and those of the opposite side 5 of the partition 4 is strictly determined by the width-wise overall dimensions of the partition 4, or of the transportation unit as a whole, which can entail the aforementioned problems during the mechanised composition of the transportation unit.

Figure 5:
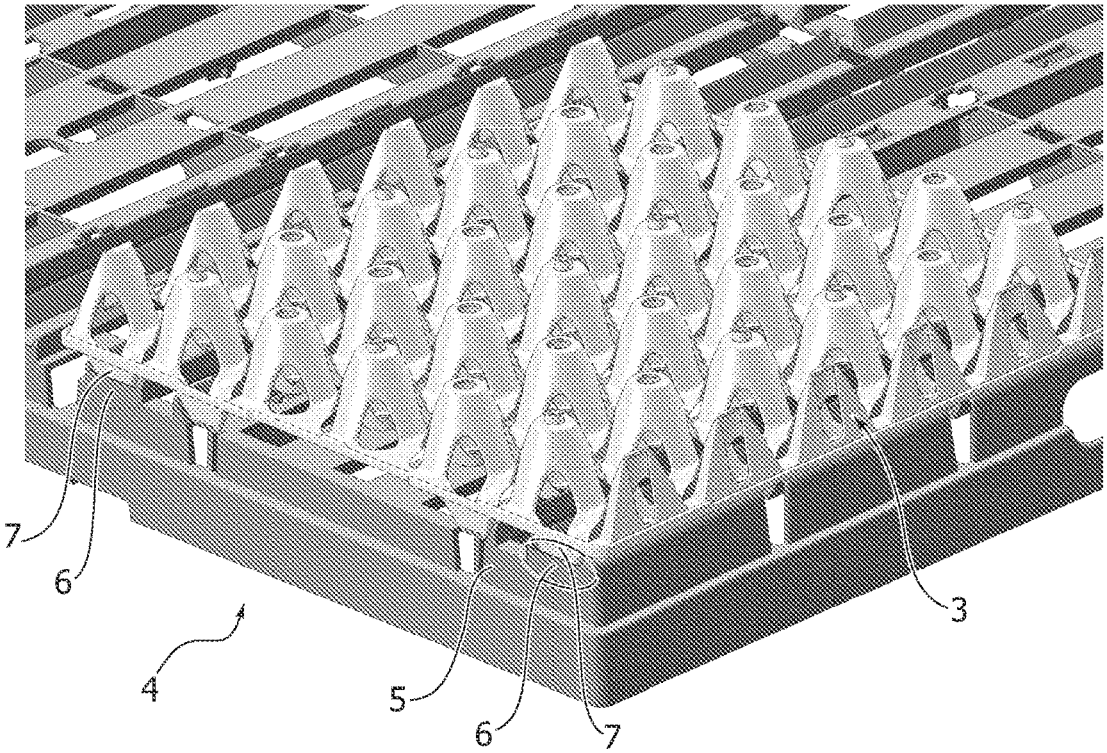
FIG. 5 is a view analogous to FIG. 4 exemplifying the distinctive characteristic of the invention.
Figure 7:
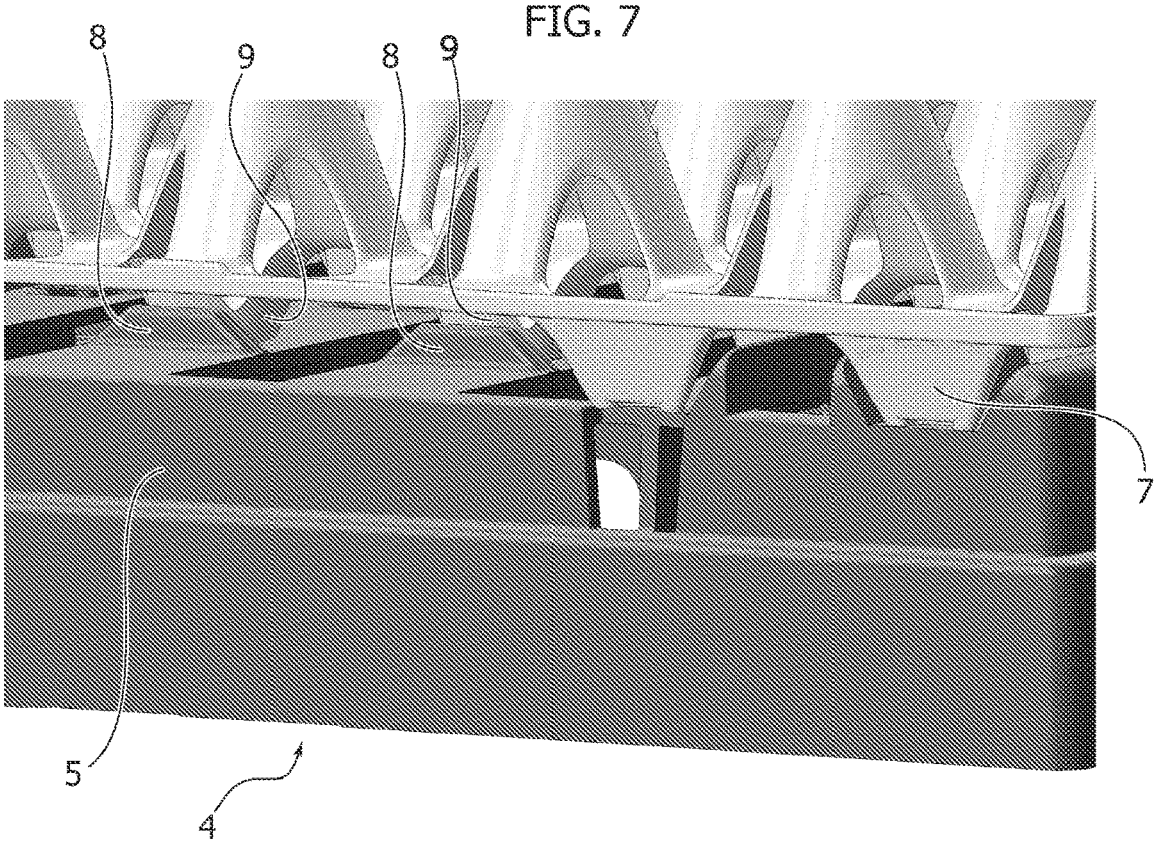
PRIOR ART FIG. 7
FIG. 7 shows an enlarged detail of FIG. 5.
Figure 9:
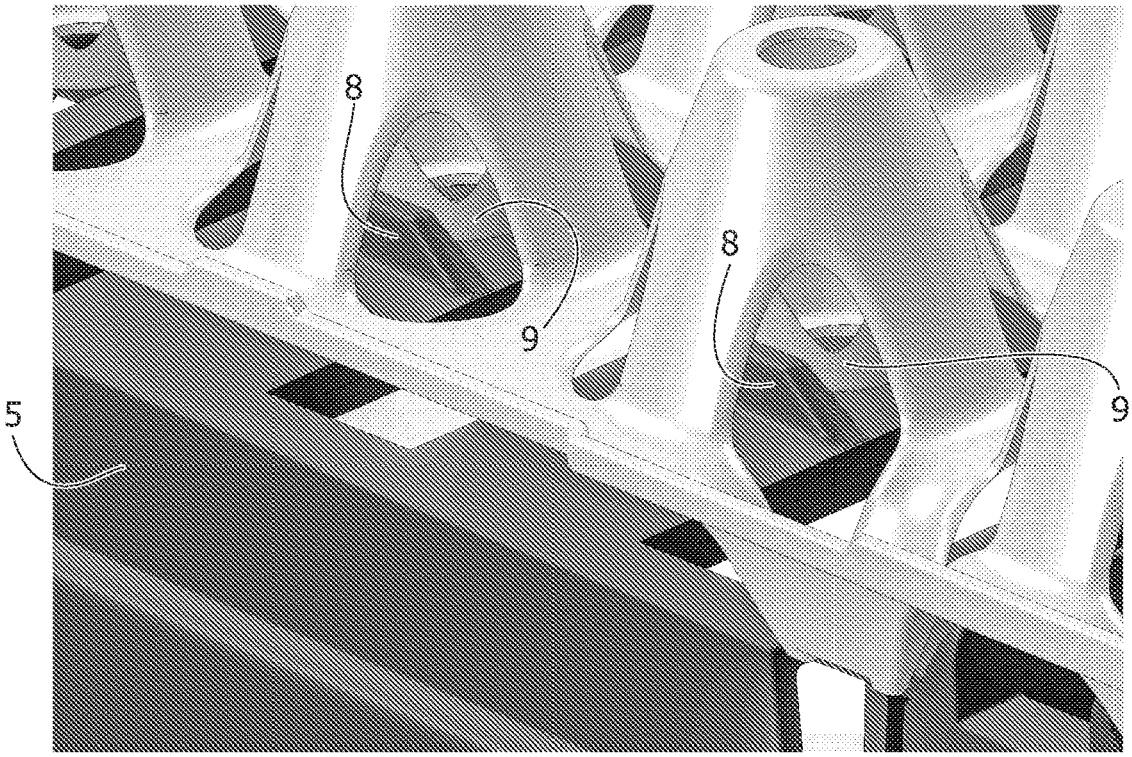
FIG. 9 shows—in a further larger scale—a detail of FIG. 5.
Figure 10:
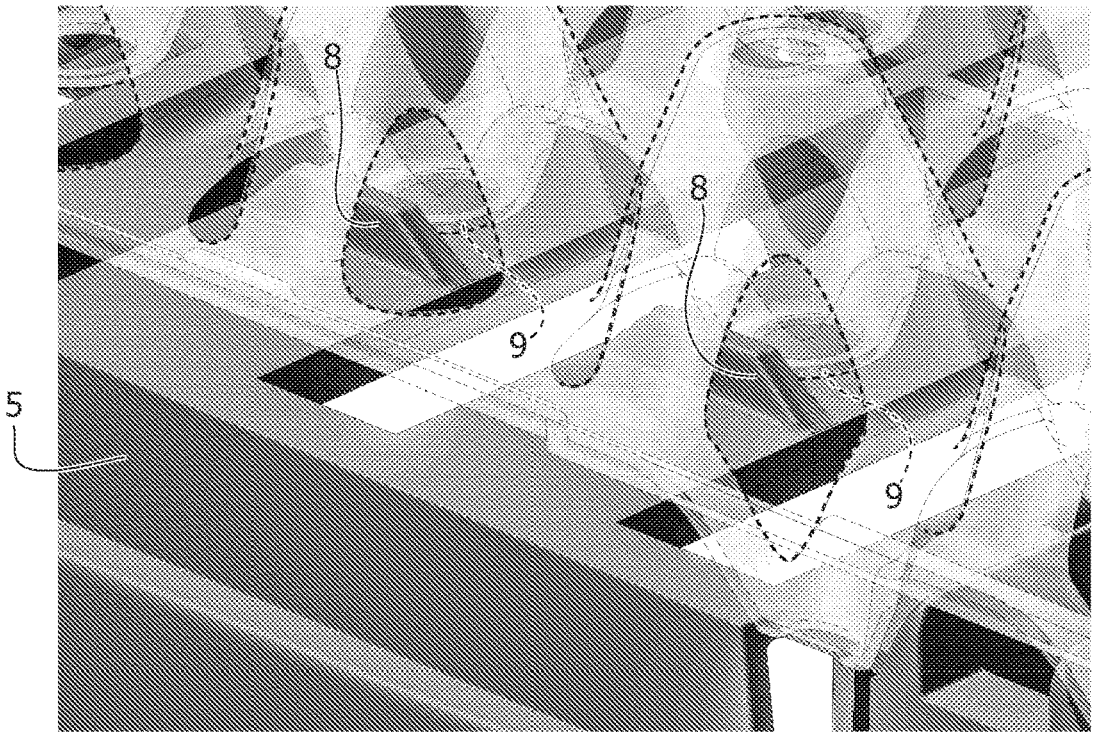
FIG. 10 is a view analogous to FIG. 9 whose part is represented transparent for greater clarity.

In order to overcome such problems, the invention provides for, as illustrated in FIGS. 5 and 7 and in further greater detail in FIGS. 9 and 10, the elimination of the peripheral projections 6, which are replaced by stop elements 8 projecting upwards from the partition 4 and receded, in positions spaced from the sides 5, 5, towards the inside of the partition 4. The internal position of the stop elements 8 is not strictly dependent on the dimensions of the partition 4 and it can thus be selected, when designing the transportation unit, in a manner such to provide a slight positioning clearance (for example measuring a few mm.) of the pluralities of superimposed layers 2*b*-2*e* of egg-holder trays 3 with respect to the sides 5, 5 of the relative partitions 4, or in the direction of the width of the transportation unit. This clearance considerably facilitates the formation of the transportation unit carried out by means of mechanised handling equipment.

Figure 8:
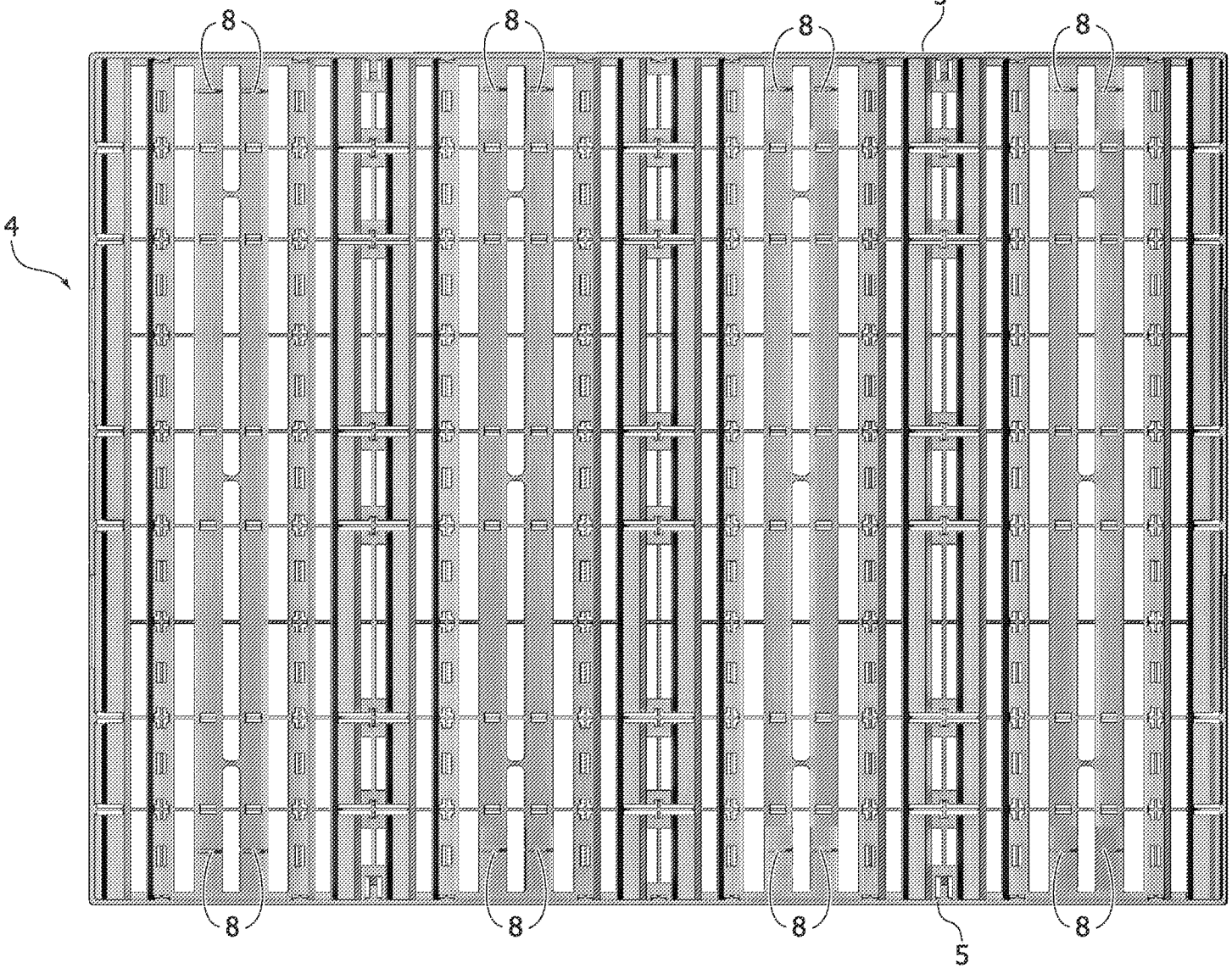
FIG. 8 is a top plan view of a partition of the transportation unit according to the invention.

As illustrated in FIG. 8, each partition 4 is conveniently provided with pairs of stop elements 8: in the case of the illustrated example, in which—as mentioned—each layer is formed by three rows of four egg-holder trays 3, there are provided for four pairs of stop elements 8 for each of the greater sides 5, 5 of the partition 4. As clearly visible in FIGS. 10 and 11 the stop elements 8 of each pair cooperate with respective lower portions 9 of the corresponding egg-holder trays.

Naturally, the effects of the present invention also extend to the designs that attain equivalent utility by applying the same innovative concept.

The invention claimed is:

1. A unit for transporting eggs comprising:

a platform with quadrangular base, a first plurality of superimposed horizontal layers of egg-holder trays resting on the platform, at least one second plurality of superimposed horizontal layers of egg-holder trays stacked on said first plurality of superimposed horizontal layers, and intermediate partitions interposed between said pluralities of superimposed horizontal layers, wherein each partition consists of a sheet whose shape corresponds to the platform and stop elements parallel to two opposite sides of each partition and projecting upwards suitable to cooperate with corresponding lower abutments of the egg-holder trays of the lowermost layer of the corresponding plurality of superimposed horizontal layers, and said stop elements spaced from said two sides of the partition, towards the inside of said partition, such that said stop elements provide a positioning clearance of the first plurality of superimposed horizontal layers and the at least one second plurality of superimposed horizontal layers relative to the two opposite sides of each partition in a direction of a width of the unit for transporting eggs and the partition is formed, for each of said two sides, with four pairs of said stop elements.

2. A unit for transporting eggs comprising:

a platform with quadrangular base;

a first plurality of superimposed horizontal layers of egg-holder trays resting on the platform;

a second plurality of superimposed horizontal layers of egg-holder trays stacked above said first plurality of superimposed horizontal layers; and an intermediate partition interposed between said first plurality of superimposed horizontal layers and said second plurality of superimposed horizontal layers, wherein said partition consists of a sheet whose shape corresponds to the platform; and stop elements parallel to two opposite sides of said partition and projecting upwards and engageable with a corresponding lower portion of the egg-holder trays of said second plurality of superimposed horizontal layers when said second plurality of superimposed horizontal layers are stacked on said partition; and said stop elements spaced from said two sides of the partition, towards the inside of said partition, such that said stop elements provide a positioning clearance of the second plurality of superimposed horizontal layers relative to the two opposite sides of each partition in a direction of a width of the unit for transporting eggs and a stop element of said stop elements engages said lower portion to stop movement of said second plurality of superimposed horizontal layers in response to a movement of said second plurality of superimposed horizontal layers in the direction of the width through the clearance; and the partition is formed, for each of said two sides, with four pairs of said stop elements.

* * * * *